US007287832B2

(12) United States Patent
Hayasaki

(10) Patent No.: US 7,287,832 B2
(45) Date of Patent: Oct. 30, 2007

(54) PRINTHEAD SUBSTRATE, PRINTHEAD AND PRINTING APPARATUS

(76) Inventor: Kimiyuki Hayasaki, Canon Kabushiki Kaisha, 3-30-2, Shimomaruko, Ohta-ku, Tokyo (JP)

( * ) Notice: Subject to any disclaimer, the term of this patent is extended or adjusted under 35 U.S.C. 154(b) by 232 days.

(21) Appl. No.: 10/810,579

(22) Filed: Mar. 29, 2004

(65) Prior Publication Data

US 2004/0201639 A1 Oct. 14, 2004

(30) Foreign Application Priority Data

Apr. 10, 2003 (JP) ..... 2003-106791

(51) Int. Cl.
*B41J 2/14* (2006.01)
*B41J 2/16* (2006.01)

(52) U.S. Cl. ..... 347/50; 347/12; 347/58

(58) Field of Classification Search ..... 347/12, 347/50

See application file for complete search history.

(56) References Cited

U.S. PATENT DOCUMENTS 6,290,334 B1 * 9/2001 Ishinaga et al. ..... 347/59
6,474,782 B1 11/2002 Furukawa ..... 347/50
6,491,377 B1 12/2002 Cleland et al. ..... 347/50
6,527,367 B2 3/2003 Yabe
6,629,742 B2 * 10/2003 Fujii ..... 347/12
6,729,708 B2 * 5/2004 Fujii ..... 347/12

FOREIGN PATENT DOCUMENTS

EP 1 078 752 A2 2/2001
EP 1 172 211 A2 1/2002
JP 11-245409 9/1999
JP 11-300973 11/1999
WO 02/074545 A1 9/2002

* cited by examiner

*Primary Examiner*—Matthew Luu
*Assistant Examiner*—Brian J. Goldberg

(57) ABSTRACT

The present invention provides a printhead substrate capable of controlling the driving of a large number of printing elements in a reduced surface area, a printhead using the printhead substrate, and a printing apparatus using the printhead. In particular, the printhead substrate, configured so that a plurality of ink supply channels are disposed in parallel on the substrate, includes a plurality of printing element arrays composed of a plurality of printing elements disposed alongside each of the plurality of ink supply channels, a plurality of drive control circuits disposed in an area between the plurality of ink supply channels that control the driving of each of the plurality of printing element arrays, and shared wiring portions disposed in the area between the plurality of ink supply channels and shared by the plurality of drive control circuits.

24 Claims, 12 Drawing Sheets

PRINTHEAD SUBSTRATE, PRINTHEAD AND PRINTING APPARATUS

CLAIM OF PRIORITY

This application claims priority from Japanese Patent Application No. 2003-106791, entitled "Printhead Substrate, Printhead and Printing Apparatus" filed on Apr. 10, 2003, the entire contents of which are incorporated herein by reference.

FIELD OF THE INVENTION

This invention relates to printhead substrate, printhead and printing apparatus, and more particularly, to a printhead substrate, printhead and printing apparatus having a multi-ink channel capable of supplying a plurality of different colored ink concurrently to a single substrate used to carry out printing according to an inkjet printing method.

BACKGROUND OF THE INVENTION

Conventionally, for the configuration of the inkjet printhead (hereinafter "printhead"), a variety of printheads comprised of a plurality of printing elements arranged in a row, or in a plurality of rows, is well known.

With such a printhead, a configuration is known that provides a concurrently drivable control wiring terminal that places N printing elements on one block and the printing elements are powered during a period in which the terminal is activated so as to enable printing onto the printing medium.

Moreover, a configuration is known that mounts several or even tens of concurrently drivable drive integrated circuits, placing N printing elements on one block, on a single substrate and aligning image data with the printing elements so as to enable printing onto the printing medium.

Thus, as printing has become of higher resolution and higher quality, the performance of the printhead has markedly improved. Throughput has been improved by increasing the number of printing elements mounted on the printhead or by increasing the number of printing elements that are concurrently driven so as to increase print speed. In addition, the performance of the printing elements themselves has advanced, so that it is now possible to discharge amounts of ink as small as several pico-liters (pl) with a drive signal having a pulse width on the order of 1 microsecond. This advance has been made possible by using functional elements (MOS-FET drivers and the like) for switching large amounts of current at high speed. These functional elements, too, continue to be downsized year after year, and as a result, multi-channel (that is, ink channels of multiple colors) inkjet printhead substrates (hereinafter "printhead substrates") also continue to be downsized.

For example, in order to achieve such printhead downsizing, there are also configurations that centralize signal processing circuits such as a latch circuit, a shift register and a decoder at a single location on the printhead substrate, as disclosed, for example, in Japanese Patent Application Laid-open No. 11-300973, with the printhead substrate comprised of printing elements themselves comprised of an ink supply port in the form of an elongated trench for supplying ink, electrothermal transducers along both sides of the ink supply port, and drive elements that drive the electrothermal transducers.

Furthermore, as disclosed in Japanese Patent Application Laid-Open No. 11-245409, there are also configurations in which an ink supply port, a printing element array, a driving circuit, another printing element array and another ink supply port are arranged in order, and the driving circuit drives both of these printing element arrays.

In particular, the need for multi-channel printheads for use mainly in compact color inkjet printheads has increased recently, because devices that can form color images at low cost are indispensable to contemporary product constructions. Several methods involving ink channels of multiple colors disposed on the same substrate have been conventionally known.

For example, there is a method involving a type that arranges the printing elements into a single row and divides the ink supply ports and ink channels by color, and allocating one row of printing element arrays to each of the plurality of ink channels. Further, a method has been proposed that disposes the printing element arrays along both sides of each of the multiple ink channels. These configurations are technical approaches indispensable to achieving high-speed, high-resolution printing, and hereafter the technical problem will be how far can downsizing proceed.

Printhead types, too, extend over a wide variety of equipment types geared to the performances of the printing apparatuses that mount the printheads, and their control circuits have become more complex. Finding the optimum disposition of the control circuits on the substrate required for the configuration of high-speed, high-resolution printheads comprised of multi-ink channels including these types of circuits is the main technical problem.

In a printing apparatus using a printhead as described above, in order to increase the print speed or increase the print density, there is a tendency to increase the number as well as the density of the printing elements provided on the printhead. As a result, the number of blocks involved when time-divisionally driving these printing elements is also increasing, with a consequent increase in the number of control signal lines as well even with the use of decoder circuits and the like.

For example, in a multi-channel printhead comprised of 256 or more printing elements in one row, a minimum combination for achieving full color printing requires the provision of three colors: cyan, yellow and magenta. The control circuits for matching the printing elements with the color image data and turning each printing element ON/OFF undergo a massive increase, with the surface area of the multi-channel printhead substrate required by just the control wiring alone reaching levels that cannot be ignored. Further, arranging printing element arrays along both sides of the ink channels requires doubling the surface area of the printhead substrate under the conventional methods and obstructs the manufacture of low-cost color inkjet printing apparatuses.

Further, in printing apparatuses that use a multi-channel printhead, the printing elements disposed opposite the ink channels are of a variety of configurations.

Basically, the two rows of printing elements disposed opposite both sides of a flow path of a single ink channel can discharge ink of the same color. In the case of such a configuration, depending on the image print process of the printing apparatus, it is possible to use a configuration that further varies the ink discharge amount even for the same color by varying the diameter of the nozzles of the printing elements and the size of the electrothermal transducers of the printing elements.

For example, by disposing the printing element arrays along both sides of the ink channel so that the ink is discharged at the same position in the arrayed direction of the printing elements, printing can be completed at twice the speed of a conventional arrangement.

Additionally, by disposing one of the rows of printing elements so as to be offset from the other row of printing elements by half a pitch in the arrayed direction of the printing elements, a multi-channel printhead substrate can be configured that has twice the resolution of the conventional arrangement.

Further, varying the ink discharge amount discharged from the printing elements belonging to each of the two rows of printing elements makes possible a printing method that can achieve high-speed, high-density printing by switching among multiple modes of the printing apparatus.

The more the image quality and functions of printing apparatuses that use multi-channel printheads, as described above the more complicated the configurations of the printhead and the peripheral control devices become, and the more difficult their control becomes as well. As a result, in order to simplify the control unit on the printing apparatus main unit side, the printhead substrate has come to be loaded with as many control circuits as possible.

Moreover, when managing/executing a control sequence that would, for example, change the drive pattern of the printing elements so as to match the print mode of the printing apparatus, in a case where inconsistencies in the manufacture of the printhead or differences between manufactured lots is large, these differences in print state can be heavily reflected in the printed image, and as a result, the functions required of a multi-channel printhead, in terms of management and calibration, and further, of distinguishing between types of printheads and of continuously monitoring the drive state, only increase.

However, the control circuits and the huge number of printing elements needed in order to implement these functions push up the cost of the printhead and are a major impediment to the spread of printing apparatuses.

SUMMARY OF THE INVENTION

Accordingly, the present invention is conceived as a response to the above-described disadvantages of the conventional art.

For example, a printhead substrate according to the present invention is capable of controlling the driving of a larger number of printing elements in a reduced surface area.

According to one aspect of the present invention, preferably, there is provided a printhead substrate having a plurality of ink supply channels disposed at predetermined intervals, comprising: a printing element array having a plurality of printing elements disposed in an area between at least two of the ink supply channels, alongside each of the ink supply channels; a drive control circuit, disposed outside the area, for controlling the driving of the printing element array; and a shared wiring portion, disposed in the area, for transferring a signal from the drive control circuit to each of the printing elements of the printing element array, and concurrently and drivably selecting a predetermined one of the printing elements of the printing element array.

According to another aspect of the present invention, preferably, the present invention may be implemented by adaptation to a printhead that uses a printhead substrate of the configuration described above.

According to still another aspect of the present invention, preferably, the present invention may be implemented by adaptation to a printing apparatus, that uses a printhead substrate of the configuration described above, for printing by discharging ink onto a printing medium.

Other objects, features and advantages of the present invention will be apparent from the following description when taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail, in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

Furthermore, unless otherwise stated, the term "nozzle" generally means a set of a discharge orifice, a liquid channel connected to the orifice and an element to generate energy utilized for ink discharge.

Furthermore, the term "on a substrate" means not only "on an element substrate", but also "the surface of an element substrate" or "inside an element substrate near the surface". The term "built-in" in the present invention does not represent that each separate element is arranged as a separate member on a substrate surface, but represents that each element is integrally formed and manufactured on an element substrate by a semiconductor circuit manufacturing process or the like.

[Brief Description of Apparatus Main Unit (FIG. 1)]

Figure 1:
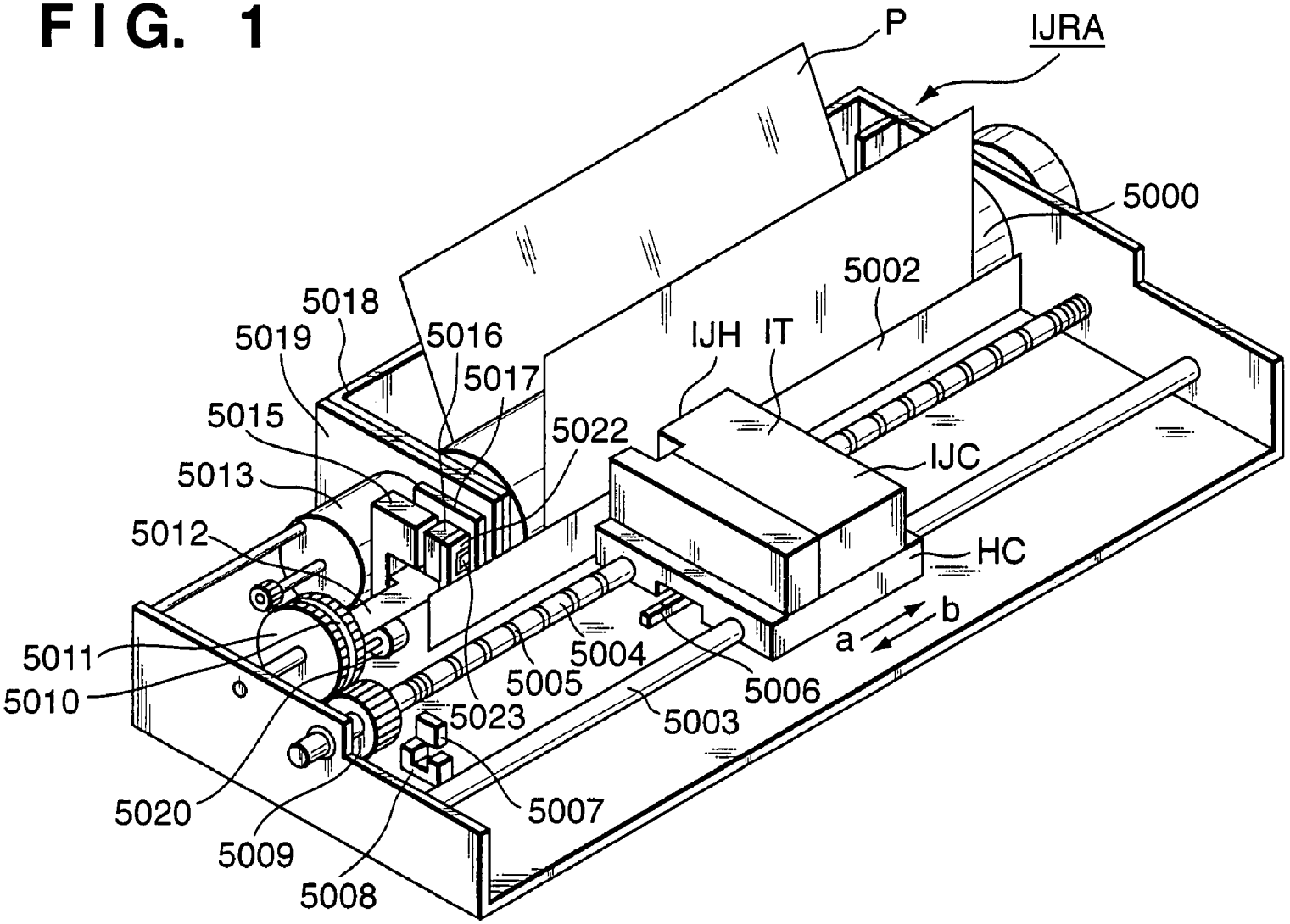
FIG. 1 is a perspective view showing an outer appearance of a carriage peripheral portion of an inkjet printing apparatus according to a representative embodiment of the present invention.

FIG. 1 is a perspective view showing the outer appearance of an inkjet printer IJRA as a typical embodiment of the present invention. Referring to FIG. 1, a carriage HC engages with a spiral groove 5004 of a lead screw 5005, which rotates via driving force transmission gears 5009 to 5011 upon forward/reverse rotation of a driving motor 5013. The carriage HC has a pin (not shown), and is reciprocally scanned in the directions of arrows a and b in FIG. 1. An inkjet cartridge IJC which incorporates an inkjet printhead IJH (hereinafter referred to as "printhead") and an ink tank IT for containing ink is mounted on the carriage HC.

The inkjet cartridge IJC integrally includes the printhead IJH and the ink tank IT.

Reference numeral 5002 denotes a sheet pressing plate, which presses a paper sheet against a platen 5000, ranging from one end to the other end of the scanning path of the carriage. Reference numerals 5007 and 5008 denote photocouplers which serve as a home position detector for recognizing the presence of a lever 5006 of the carriage in a corresponding region, and used for switching, e.g., the rotating direction of the motor 5013. Reference numeral 5016 denotes a member for supporting a cap member 5022, which caps the front surface of the printing head IJH; and 5015, a suction device for sucking ink residue through the interior of the cap member. The suction device 5015 performs suction recovery of the printing head via an opening 5023 of the cap member 5015. Reference numeral 5017 denotes a cleaning blade; 5019, a member which allows the blade to be movable in the back-and-forth direction of the blade. These members are supported on a main unit support plate 5018. The shape of the blade is not limited to this, but a known cleaning blade can be used in this embodiment. Reference numeral 5012 denotes a lever for initiating a suction operation in the suction recovery operation. The lever 5012 moves upon movement of a cam 5020, which engages with the carriage, and receives a driving force from the driving motor via a known transmission mechanism such as clutch switching.

The capping, cleaning, and suction recovery operations are performed at their corresponding positions upon operation of the lead screw 5005 when the carriage reaches the home-position side region. However, the present invention is not limited to this arrangement as long as desired operations are performed at known timings.

Figure 2:
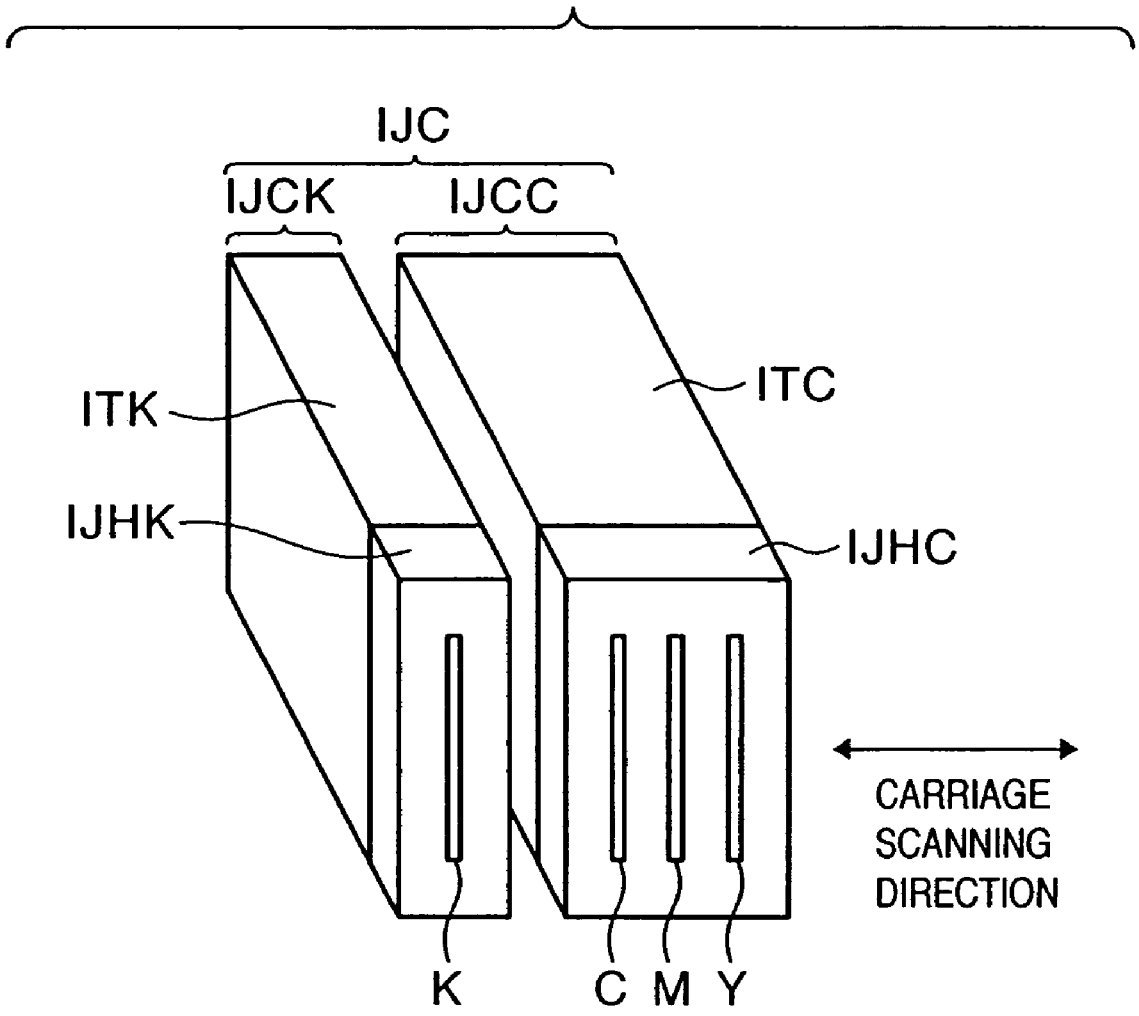
FIG. 2 is a perspective view showing a detailed outer appearance of an inkjet cartridge IJC.

FIG. 2 is a perspective view showing a detailed outer appearance of the configuration of an inkjet cartridge IJC.

As shown in FIG. 2, the inkjet cartridge IJC is comprised of a cartridge IJCK that discharges black ink and a cartridge IJCC that discharges three colors of ink, cyan (C), magenta (M) and yellow (Y). These two cartridges are mutually separable, with each being independently detachably mounted on the carriage HC.

The cartridge IJCK is comprised of an ink tank ITK that contains black ink and a printhead IJHK that prints by discharging black ink, combined in an integrated structure. Similarly, the cartridge IJCC is comprised of an ink tank ITC that contains ink of three colors, cyan (C), magenta (M) and yellow (Y), and a printhead IJHC that prints by discharging ink of these colors, combined in an integrated structure.

Further, as can be appreciated from FIG. 2, an array of nozzles that discharges black ink, an array of nozzles that discharges cyan ink, an array of nozzles that discharges magenta ink and an array of nozzles that discharges yellow ink are aligned in a direction of movement of the carriage, the arrayed direction of the nozzles being disposed perpendicular to the carriage movement direction.

Figure 3:
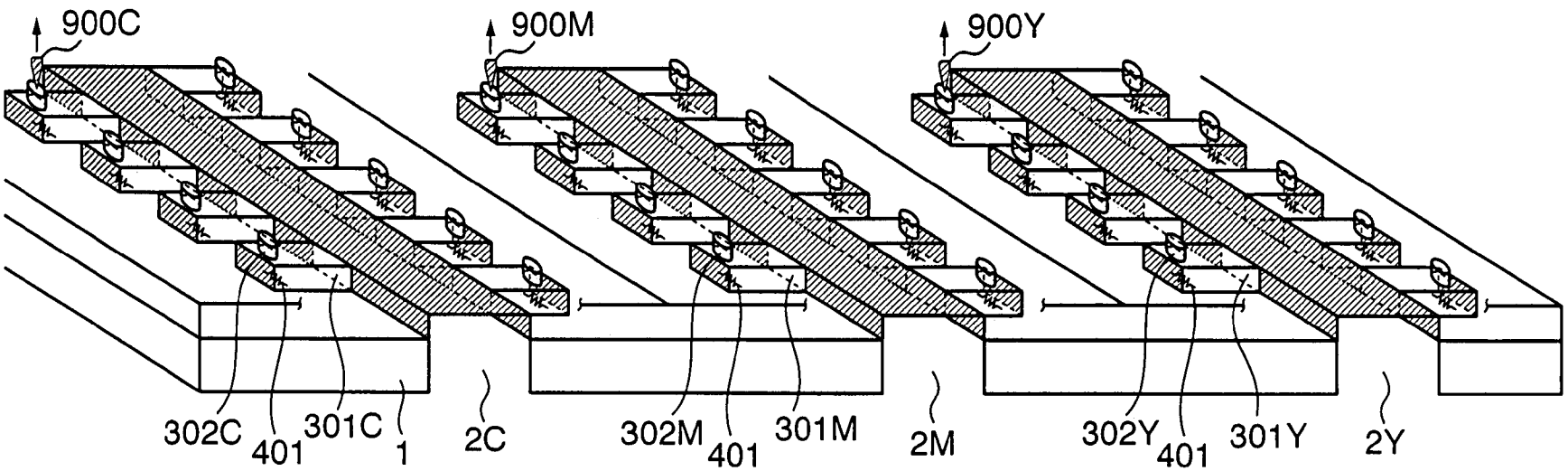
FIG. 3 is a perspective view showing a three-dimensional structure of a printhead IJHC that discharges three colors of ink.

FIG. 3 is a perspective view showing a three-dimensional structure of a printhead IJHC that discharges three colors of ink.

FIG. 3 shows the flow of ink supplied from the ink tank ITK. The printhead IJHC has an ink channel 2C that supplies cyan (C) ink, an ink channel 2M that supplies magenta (M) ink, and an ink channel 2Y that supplies yellow (Y) ink, and is provided with supply paths (not shown), that supply each of the inks via a rear surface of the substrate from the ink tank ITK to each of the ink channels.

The cyan, magenta and yellow inks that pass through the ink channels ink flow paths 301C, 301M and 301Y, respectively, are each led to electrothermal transducers (that is, heaters) 401 provided on the substrate. Then, when the electrothermal transducers (heaters) 401 are activated via circuits to be described later, the ink on the electrothermal transducers (heaters) 401 is heated, the ink boils, and, as a result, ink droplets 900C, 900M and 900Y are discharged from the orifices 302C, 302M and 302Y by the bubble that arises.

It should be noted that, in FIG. 3, reference numeral 1 denotes a printhead substrate (hereinafter referred to as "head substrate") on which are formed electrothermal transducers and the variety of circuits that drive the electrothermal transducers to be described later, a memory, a variety of pads that form the electrical contacts with the carriage HC, and a variety of signal wires.

Moreover, one electrothermal transducer (heater), the MOS-FET that drives it and the electrothermal transducer (heater) are together called a printing element, with a plurality of printing elements called a printing element.

Note that although FIG. 3 is a diagram showing a three-dimensional structure of a printhead IJHC that discharges three colors of ink, the structure is the same as that of the printhead IJHK that discharges black ink but comprising one third of the configuration shown in FIG. 3. In other words, there is one ink channel, and the scale of the printhead is approximately one third that of the structure shown in FIG. 3.

Next, a description is given of the control configuration for executing print control of the printing apparatus described above.

Figure 4:
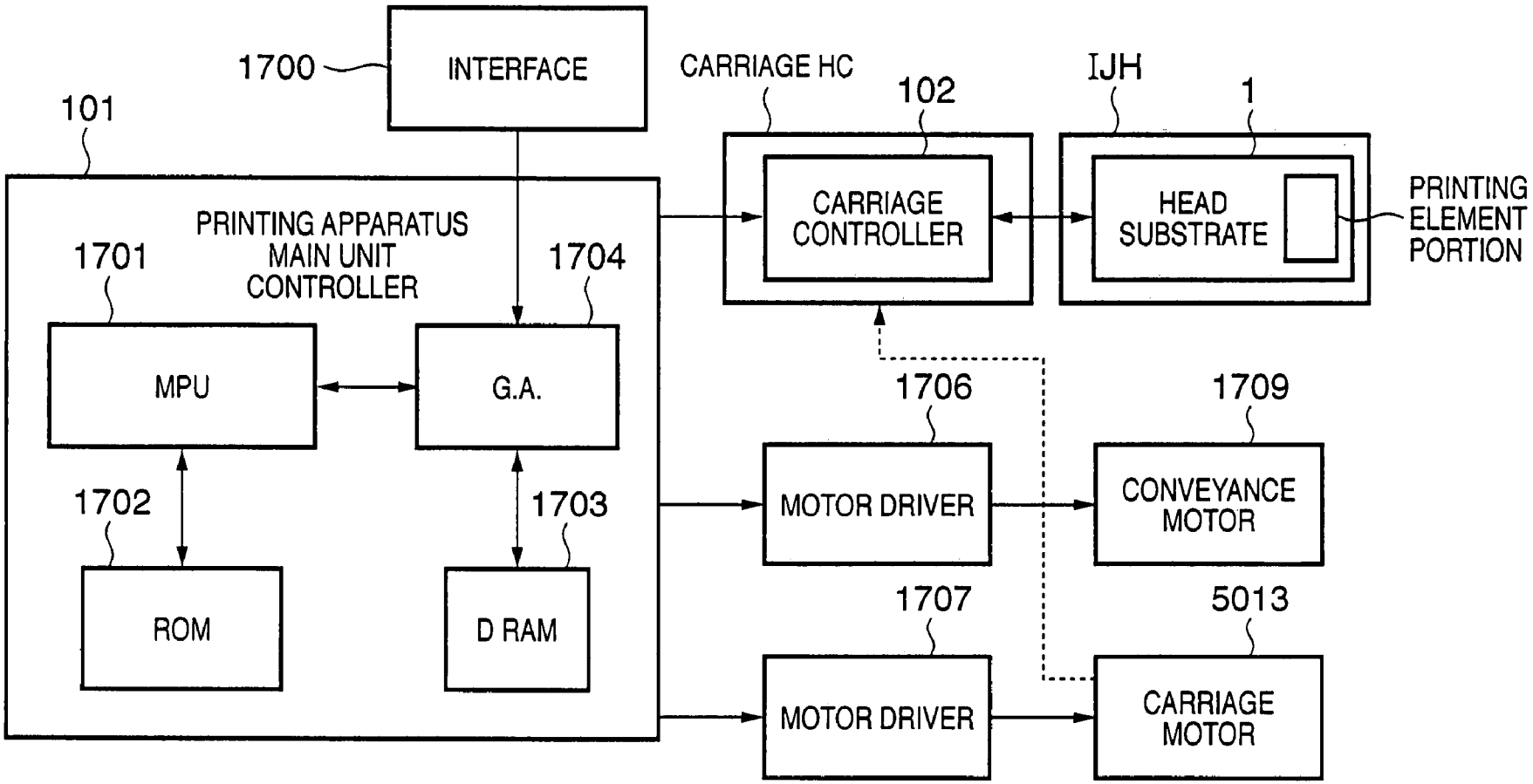
FIG. 4 is a block diagram showing the control configuration of the printing apparatus shown in FIG. 1.

FIG. 4 is a block diagram showing the arrangement of a control circuit of the printer.

Referring to FIG. 4 showing the control circuit, reference numeral 1700 denotes an interface for inputting a printing signal; 1701, an MPU; 1702, a ROM for storing a control program executed by the MPU 1701; and 1703, a DRAM for storing various data (the printing signal, printing data supplied to the printhead, and the like). Reference numeral 1704 denotes a gate array (G.A.) for performing supply control of printing data to the printhead IJH. The gate array 1704 also performs data transfer control among the interface 1700, the MPU 1701, and the RAM 1703.

The above is a general configuration of a printing apparatus main unit controller 101.

Reference numeral 1709 denotes a conveyance motor (not shown in FIG. 1) for conveying a printing sheet P. Reference numeral 1706 denotes a motor driver for driving the conveyance motor 1709, and reference numeral 1707 denotes a motor driver for driving the carriage motor 5013.

The operation of the above control arrangement will be described next. When a printing signal is input to the interface 1700, the printing signal is converted into printing data for a printing operation between the gate array 1704 and the MPU 1701. The motor drivers 1706 and 1707 are driven, and the printhead IJH is driven in accordance with the printing data supplied to the carriage HC, thus printing an image on the printing paper P.

It should be noted that, when driving the printing element portion of the printhead IJH, in order to carry out optimum driving, the characteristic information stored in the memory on the head substrate 1 is referred and the drive form of the printing elements is determined.

Moreover, the drive control of the head substrate 1 is not carried out directly from the printing apparatus-main unit controller 101 but through the carriage controller 102 integrated inside the carriage HC.

Next, a description is given of the configuration of the layout of the circuits on the head substrate according to the present embodiment, while comparing such layout to the layout generally adopted.

Figure 5:
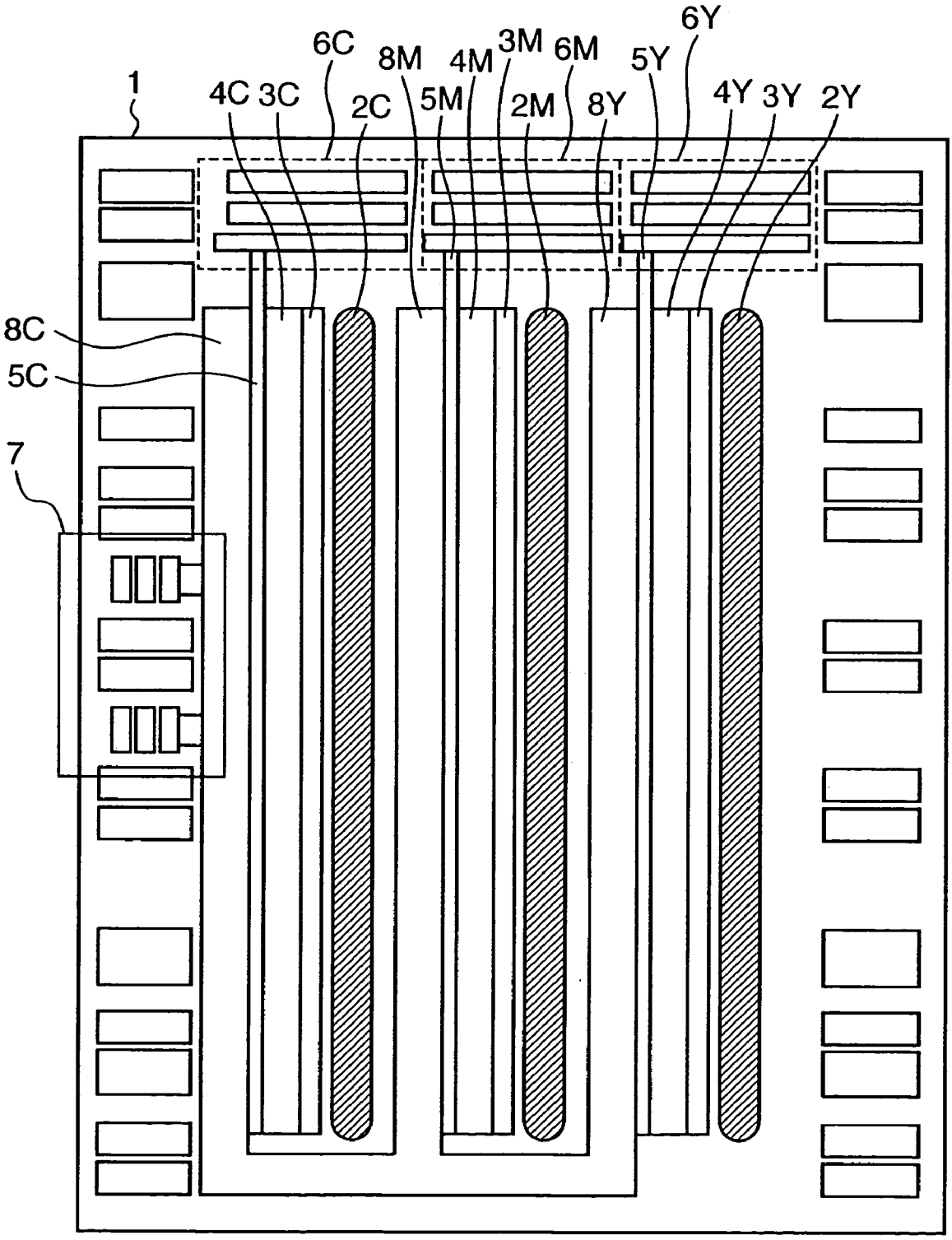
FIG. 5 is a diagram showing the circuit layout of a typical head substrate.

FIG. 5 is a diagram showing the circuit layout of a typical head substrate.

In the configuration shown in FIG. 5, ink channels 2C, 2M and 2Y corresponding to cyan (C) ink, magenta (M) ink and yellow (Y) ink, respectively, are formed on the substrate 1 by a process such as anisotropic etching or sand blasting. The ink channels 2C, 2M and 2Y are disposed at predetermined intervals. Such intervals may be identical. For each channel, printing element arrays 3C, 3M and 3Y are formed into rows on the substrate. The rows may be of different levels in units of a few nozzles.

It is preferable that the ink channels are arranged in parallel rows on the substrate due to the disposition of the circuits on the substrate. However, the arrangement is not limited to the disposition described above.

Further, MOS-FET driver arrays 4C, 4M and 4Y that control the driving of the printing element arrays 3C, 3M and 3Y individually, and the circuit wires 5C, 5M and 5Y are that make their individual control possible, are built into the substrate.

Many contemporary substrates have configurations that integrate not only the printing element arrays described above but also integrate the functional elements such as the driver arrays as well as the control circuits for the driver arrays, and thus contribute to reducing the cost of the printing apparatus. Among these circuits are logic control circuit units (hereinafter referred to as "control circuits") 6C, 6M and 6Y, which are also built into the substrate, are comprised of shift registers, latches and the like, and play important roles in controlling individually the printing element arrays that are themselves comprised of hundreds of printing elements.

By providing such a configuration as described above, even assuming that the number of printing elements increases, there is no need to increase the number of control terminals for receiving signals from outside the substrate to match the number of printing elements. As a result, a head substrate having a control circuit comprised of a combination of the above control circuits have come to be the standard substrate type.

It should be noted that, in FIG. 5, reference numeral 7 denotes a circuit that time-divisionally drives groups of printing elements that are selectively controlled individually by control circuits 6C, 6M and 6Y, and ordinarily is comprised of a decoder circuit and a shift register circuit.

Moreover, the configuration of the wiring for the circuits that are formed on the head substrate varies widely depending on the functions of the printhead. Further, those parts of the substrate shown in FIG. 5 that are not given reference numerals are terminals (that is, pads) that provide a print current to the substrate, input control signals for print control, and so forth.

A plurality of wirings for control extended from the time-division drive circuit 7 are shared by all channels, and therefore meander across the surface of the head substrate 1. With the typical configuration like that shown in FIG. 5, it is necessary to provide wires 8C, 8M and 8Y at every ink channel. However, when doubling the number of printing elements using this conventional substrate, the space required by these individual wires 8C, 8M and 8Y are one factor causing the size of the substrate to increase greatly.

Figure 6:
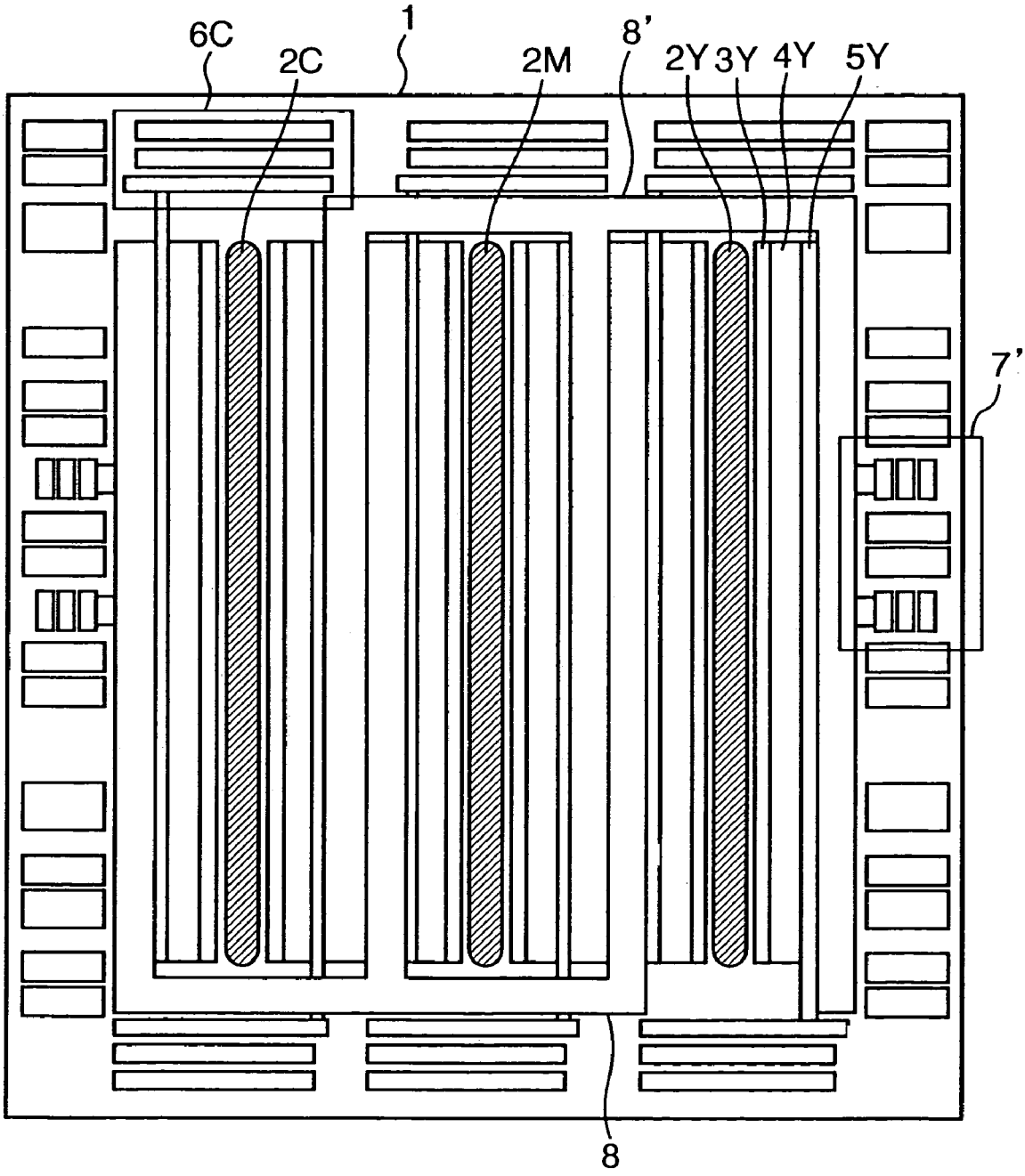
FIG. 6 is a diagram showing an example of a circuit layout of a head substrate with double the printing elements of the typical head substrate shown in FIG. 5.

FIG. 6 is a diagram showing an example of a circuit layout of a head substrate with double the printing elements of the typical head substrate shown in FIG. 5.

In FIG. 6, reference numeral 8 denotes the individual wires 8C, 8M and 8Y shown in FIG. 5 as a whole, reference numeral 7' denotes an additional time-division drive circuit necessitated by the doubling of the number of printing elements, and reference numeral 8' denotes as a whole additional wires necessitated by the doubling of the number of printing elements.

According to the configuration shown in FIG. 6, as shown by the individual wiring 8 and 8', two sets of the control wires are disposed between the ink channels 2C, 2M and 2Y and the control circuits also double together with the wiring, resulting in a wiring layout in which the configuration shown in FIG. 5 with substantially half the number of nozzles is approximately doubled. When manufacturing a substrate using a semiconductor production process, such a configuration also affects the number of chips that can be produced per wafer and the yield, and therefore a further reduction in substrate size is desirable.

Figure 7:
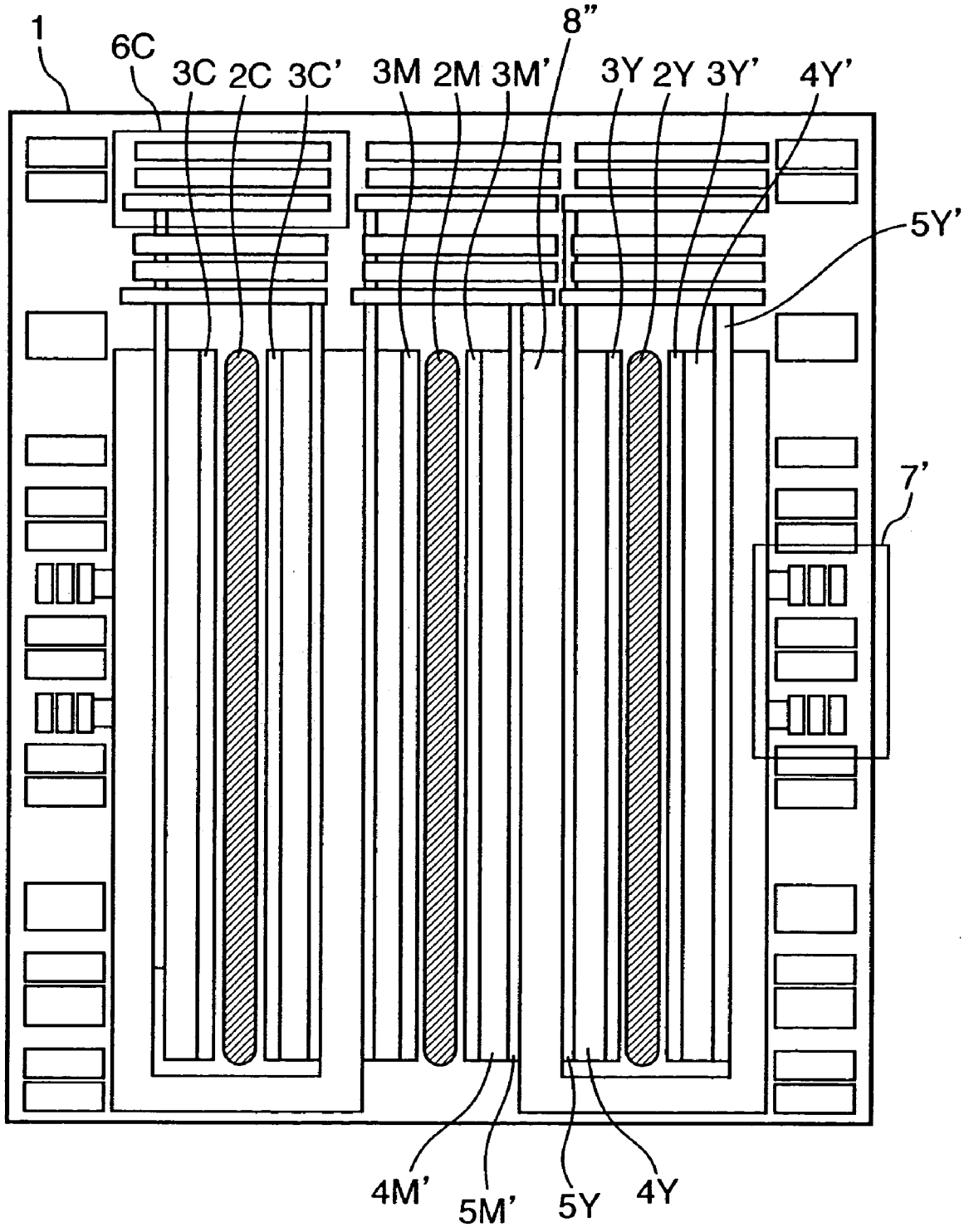
FIG. 7 is a diagram showing an example of a circuit layout of a head substrate integrating twice the number of printing elements of the typical head substrate shown in FIG. 5, according to one embodiment of the present invention.

FIG. 7 is a diagram showing an example of a circuit layout of a head substrate integrating twice the number of printing elements of the typical head substrate configuration, according to one embodiment of the present invention.

The head substrate shown in FIG. 7 is one example of a head substrate used in the printhead IJHC shown in FIG. 3. In the configuration shown in FIG. 3, the printing elements are provided along both sides of each ink channel. Likewise, the configuration shown in FIG. 7 also provides printing elements 3C, 3C', 3M, 3M', 3Y and 3Y' along both sides of the ink channels 2C, 2M and 2Y.

According to the configuration shown in FIG. 7, as is clear from a comparison with FIG. 6, a control wire 8' provided between ink channel 2C and ink channel 2M, and between ink channel 2M and ink channel 2Y, is shared, thus providing a wiring space reduction that is substantially equivalent to two control wires.

Since the number of blocks that are time-divisionally driven increases as the number of printing elements increases, the wiring area required for the control wires cannot be ignored. Therefore, according to the present embodiment, the control wires are laid so as to provide shared control over the plurality of printing element arrays 3C and 3C', 3M and 3M', and 3Y and 3Y', thus achieving a head substrate area reduction as shown in FIG. 7.

It should be noted that the present invention is not limited to a head substrate layout as shown in FIG. 7. Accordingly, alternatively, a substrate layout like that shown in FIG. 8, for example, may be adopted.

Figure 8:
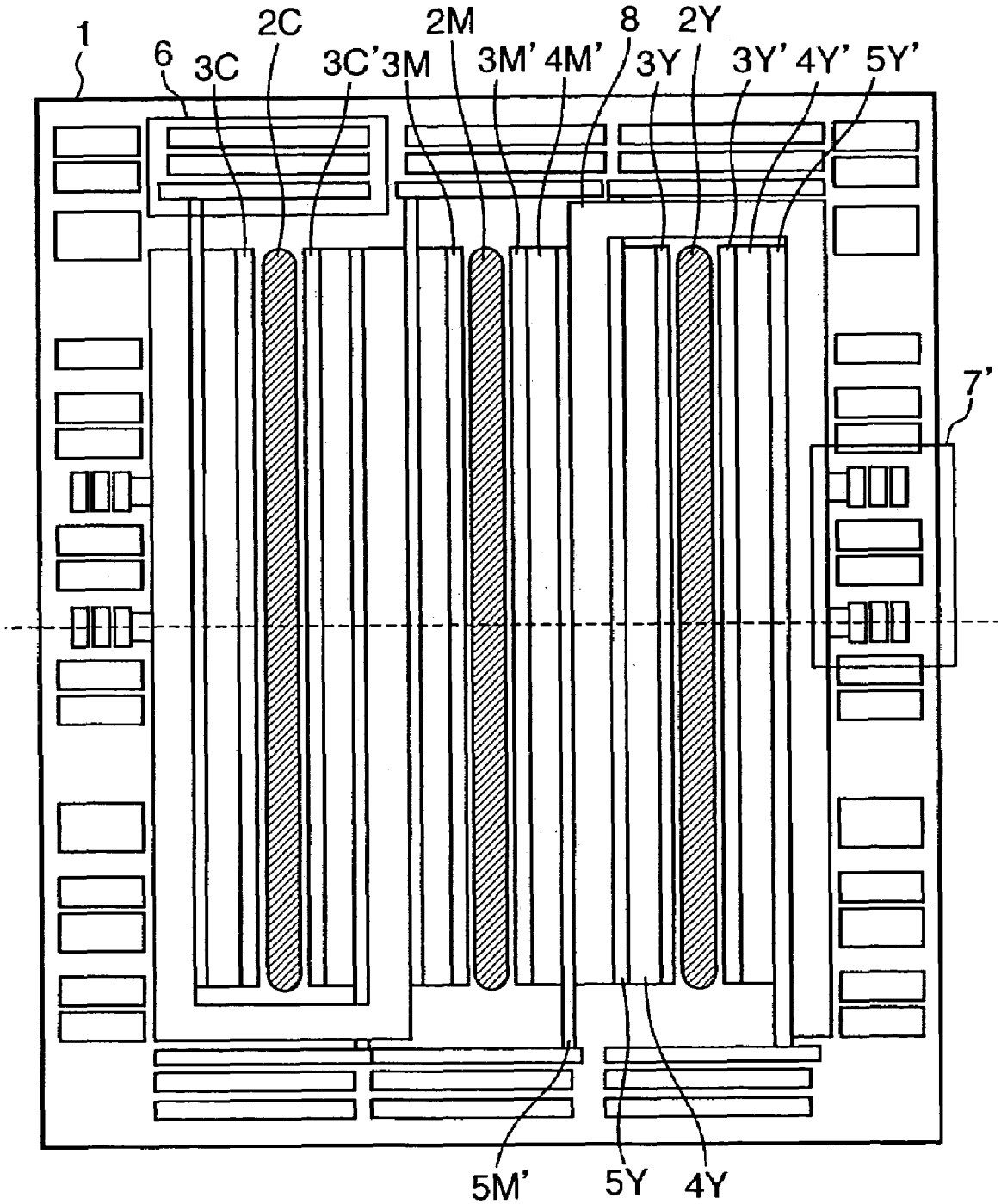
FIG. 8 is a diagram showing an example of a circuit layout of a head substrate that further develops the configuration shown in FIG. 7.

FIG. 8 is a diagram showing an example of a circuit layout of a head substrate that further develops the configuration shown in FIG. 7.

In the present example, the individual control circuits 6 and associated wires 8 needed as the number of printing elements is doubled are distributed among circuits configured so as to be symmetrical about a straight line (that is, the broken line shown in FIG. 8) connecting substantially the center portions of each of the ink channels 2C, 2M and 2Y, thereby equalizing the control line and optimizing both circuits and wires.

Equalization of control circuits is an important consideration in substrate layout. As a result, the layout of the head substrate shown in FIG. 8 is superior to that shown in FIG. 7 in terms of a function of a printhead (e.g. optimized ink channel location).

Figure 9:
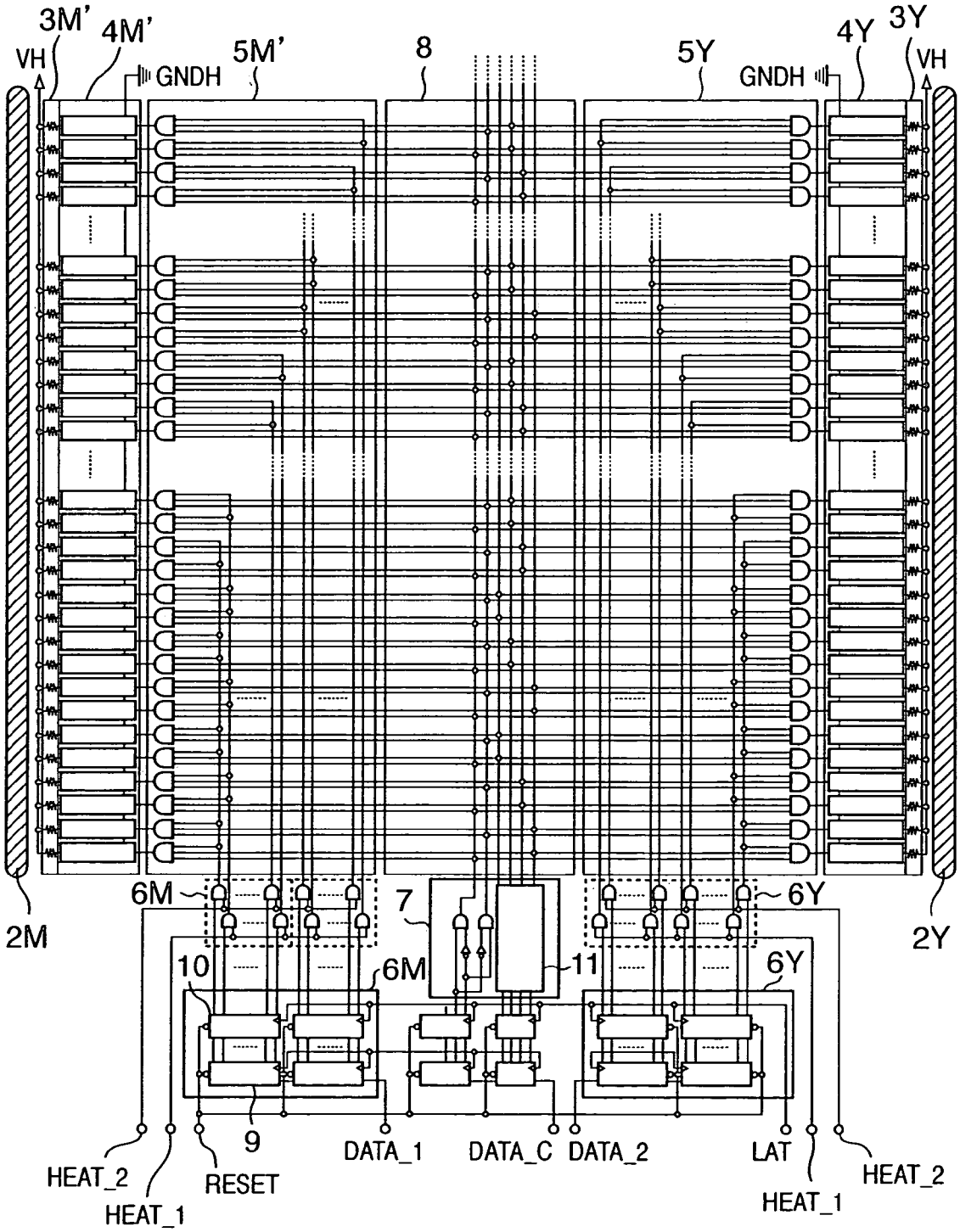
FIG. 9 is an equivalent circuit diagram showing the drive control configuration of a head substrate having the layout shown in FIGS. 7-8.

FIG. 9 is an equivalent circuit diagram showing the drive control configuration of a head substrate having the layout shown in FIGS. 7-8. Here, for simplicity of description, the description treats only the circuit disposed between the ink channels 2M and 2Y that are the most characteristic examples of the present embodiment of the present invention, and describes the circuit structure thereof.

As shown in FIG. 9, the two ink channels 2M and 2Y are disposed at both sides of this diagram. The ink channels 2M and 2Y are respectively connected to the printing element arrays 3M' and 3Y, in turn, respectively connected to the driver arrays 4M' and 4Y, and in turn, respectively connected to control wires and AND circuit arrays 5M' and 5Y that enable individual control of these elements. Depending on the output logic of each of the AND circuit arrays 5M' and 5Y, the driver arrays 4M' and 4Y are driven individually so as to print. That is, an electric current that causes ink discharge is sent through the relevant printing elements of the printing element arrays 3M' and 3Y.

The energy applied to the common electrode VH connected to the printing element arrays 3M' and 3Y is fed back by connecting the driver arrays 4M' and 4Y to a ground GNDH served as a shared grounded conductor. By controlling the width of the pulse of this feedback current, ink discharge can be optimized. Enable circuits inside the circuits 6M' and 6Y that determine the width of the feedback current pulse and control individual printing elements are customized to match the functions provided to the printhead.

For example, in the configuration shown in FIG. 9, the circuits are configured so as not to drive adjacent printing elements concurrently. If adjacent printing elements are to be driven concurrently, a phenomenon in which ink is insufficiently supplied adjacent nozzles (i.e., crosstalk) occurs because the inflow and outflow of ink occur at positions near each other. In order to prevent the occurrence of this phenomenon, the circuits of the head substrate are configured so as not to drive adjacent printing elements concurrently, thus physically preventing the occurrence of this phenomenon.

Additionally, there is also the matter of drive control matched to a used amount of ink of the ink cartridge that contains the ink, and in particular the used amount of ink in an ink cartridge for an inkjet printhead. In this case, drive control varies considerably due to such factors as ink color information and date of manufacture, differences in the viscosity of the inks, and differences in the use applications.

In order to accommodate the need for even faster and high-resolution printing using a printhead like that described above, print control methods have been proposed that involve doubling the number of ink discharge elements inside the printhead while providing printhead temperature detection means, means for arbitrarily changing the drive method using an externally input signal, and means for detecting printhead tolerance due to manufacturing inconsistencies. It should be noted that drive control methods such as these are beyond the scope of the present invention and are not further described herein.

To return to the description of the present embodiment, the circuit structure of the present embodiment is such that, by changing the heater resistance and the nozzle shapes of adjacent printing elements, different amounts of ink discharge can be achieved. Then, by alternating the disposition of high-resistance heaters (that is, large heaters) and low-resistance heaters (that is, small heaters), a pair consisting of one large heater and one small heater can be drive controlled. A drive control that takes into account the effects of the crosstalk described above would form such a pair into a single circuit structure.

In addition, restricting the concurrent driving of printing elements also has another benefit of reducing induction noise due to concentration of the print current.

As described above, the head substrate passes an electric current of one hundred-plus milliamps (mA) through each printing element. Moreover, the width of the pulse of that print current is a few microseconds or less, and the pulse rise and pulse fall time is a hundred nanoseconds or less. As a result, the induced electromotive force due to passing the print current concurrently through adjacent printing elements, depending on the length of the printing element arrays, might become noise that exceeds the logic level of the drive control circuits. The occurrence of such noise causes the drive control circuits to malfunction, disrupting proper print control.

To cope with such a disturbance, as shown in FIG. 9, the head substrate of the present embodiment separates the signal input terminals HEAT_1 and HEAT_2 that control the width of the print current pulse, so as to make it possible to provide an optimum delay.

In order to selectively print control each of a plurality of printing elements, it is necessary to process the print data transferred from the host. This sort of image processing is executed by the printing apparatus main unit controller 101. For example, if the print data from the host is vector data or a command string described by PDL, the MPU 1701 processes this print data and develops it into bitmap data.

A method is known in which, after bitmapping data to be input into a multi-channel printhead, the data is divided into DATA_1, DATA_2, DATA_C and input individually into each of the input terminals shown in FIG. 9. These data signals are basically serial data, and through the input terminals are supplied to the shift register circuit 9, divided into appropriate lengths and temporarily stored in the latch circuit 10. The data is retained until input of the next data, and if the HEAT_1, HEAT_2 signals that control the activation of the printing elements as described above are input in the meantime, the printing elements are selectively activated in accordance with the print data.

As shown in FIG. 9, in the case of a multi-channel printhead, two of the various circuit blocks described up to this point are disposed opposite each other between two of the ink channels. What can share these two circuit blocks for control is the circuit block and its associated wiring, which achieve time-division drive.

The most characteristic circuit block structure of the present embodiment is to arrange the shared wirings 8 for time-division drive between the above-described two circuit blocks.

By employing a substrate layout as described above, the circuit layout can be optimized. In other words, the wiring 8 for time-division drive disposed at the center of the head substrate concurrently controls a plurality of printing elements selectively by the control circuits 7 disposed on a place where the wiring 8 is extended. This circuit is often implemented by a decoder circuit 11 based on decode data input from input terminal DATA_C and the like.

It should be noted that, even if the wiring 8 for time-division drive is shared, by changing the connection between this wire and the printing elements, the time-divisional driving sequence can be changed at each printing element array.

Recently, in order to print images having photographic quality, combinations of large and small heaters are sometimes drive controlled as described above. Such control is achieved by a selection logic composed of an AND circuit and an inverter disposed outside the decoder circuit 11 within the control circuit 7. The signal line for carrying out such control can also be shared as shown in FIG. 9, just like the wiring 8 for time-division drive. Such commonality suggests that other and further functions that can be predicted hereafter can be disposed for shared use as well.

It should be noted that although two sets of input terminals (HEAT_1, HEAT_2) for control signals that control the pulse width of the print current to the printing elements as well as of the associated signal wires are provided for each of the two circuit blocks disposed opposite each other as described above, it goes without saying that these terminals and signal wires may also be shared, provided there is no particular need to change the width of the pulse of the print current supplied to the printing element arrays disposed along both sides as shown in FIG. 9.

The circuits of the head substrate described above are based on the head substrate layout shown in FIGS. 7 and 8, and are examples in which the print data input terminals (DATA_1, DATA_2) that input to the shift register circuit 10 inside the individual control circuits 6M an 6Y and the input terminal (DATA_C) that inputs decode data to the time-division drive control circuit 7 are separated. However, alternatively, these data inputs may be consolidated in a single terminal, thereby further reducing the number of terminals.

In any case, by adopting a layout that disposes, in an area between two ink channels on the head substrate, a dedicated circuit block that controls each of two printing element arrays that receive ink supply from each of the ink channels so as to print, signal lines associated with the circuit block, and shared signal lines for controlling the printing element arrays according to the embodiment described above, the head substrate can be used more efficiently, and further, the area of the head substrate can be further downsized.

It should be noted that although the embodiment described above refers only to the configuration between the ink channel that supplies magenta ink and the ink channel that supplies yellow ink, it goes without saying that the same layout can be implemented between the ink channel that supplies cyan ink and the ink channel that supplies magenta ink.

OTHER EMBODIMENTS

Although the head substrate of the embodiment described above is provided with a shift register circuit and a decoder circuit, such circuits are not absolutely essential to driving the printing elements. In the present embodiment, a description is given of a substrate layout that does not use a shift register circuit or decoder circuit, while comparing such a substrate layout with a generally known substrate layout.

Figure 10:
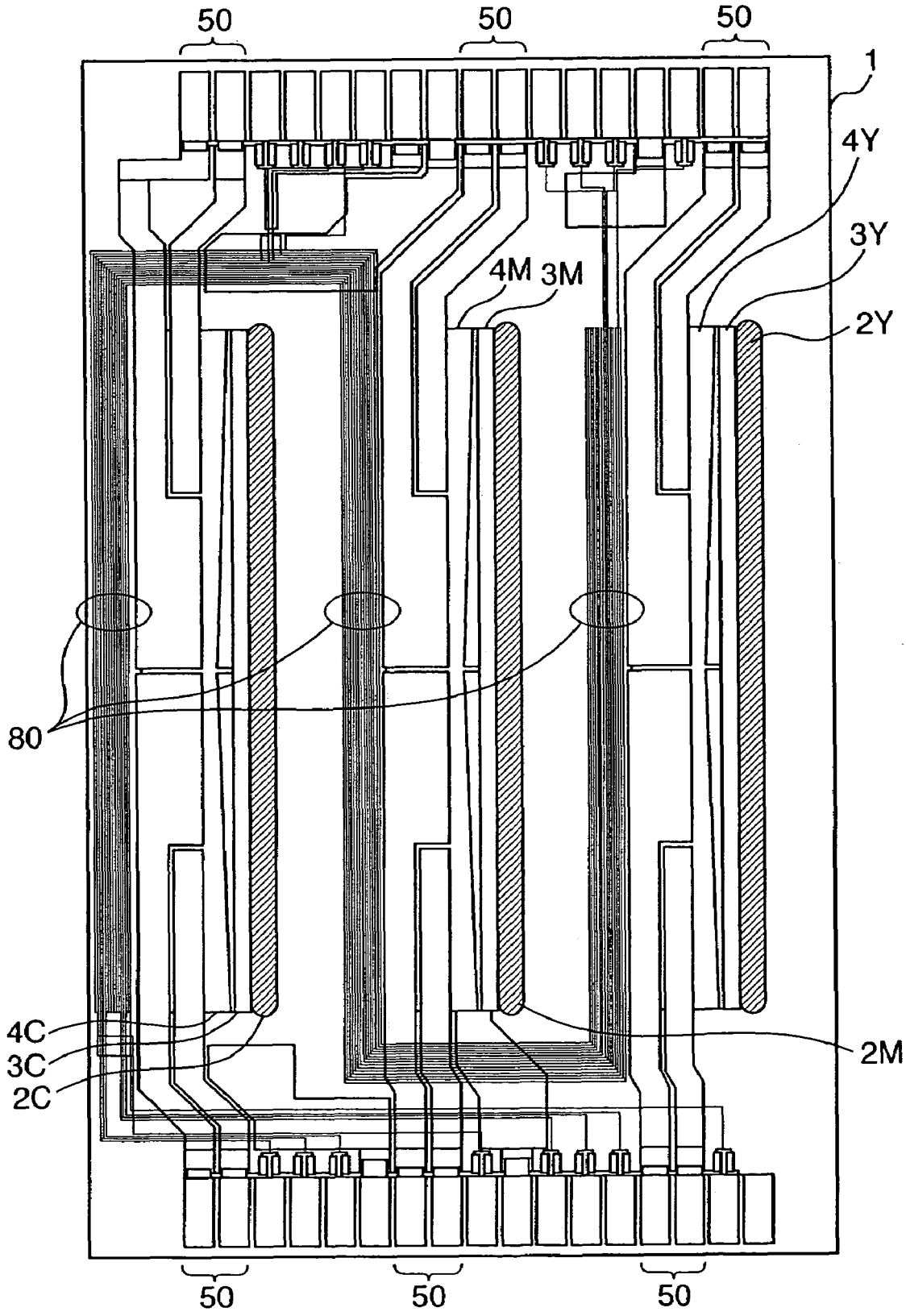
FIG. 10 is a diagram showing another example of a circuit layout of a typical head substrate.

FIG. 10 is a diagram showing another example of a circuit layout of a typical head substrate. It should be noted that, in FIG. 10, constituent elements identical to those of the embodiment described above are assigned identical reference numerals and a description thereof is omitted herein.

According to FIG. 10, such a configuration is comprised of shared conductor terminals 50 for a plurality of printing element groups disposed so as to be concurrently drivable, together with a matrix-like wirings 80 capable of time-divisionally controlling the activation of the printing element groups. In order to individually enable the wirings 80, a specific logic level voltage is applied to an individual control terminal (not denoted by any reference numeral in FIG. 10) other than the shared conductor terminal 50.

The arrangement of the head substrate 1 that uses the matrix-like wirings 80 to control the activation of the printing elements does not require complicated logic circuitry, and therefore can reduce the cost of the substrate itself. As a result of this advantage, such a configuration is employed in relatively inexpensive printheads. However, a problem arises when the number of printing elements increases and consequently the number of connecting terminals on the head substrate also increases.

Next, a description is given of a head substrate layout in a case where the printing element arrays is extended, assuming a configuration that uses the matrix-like wirings described above.

Figure 11:
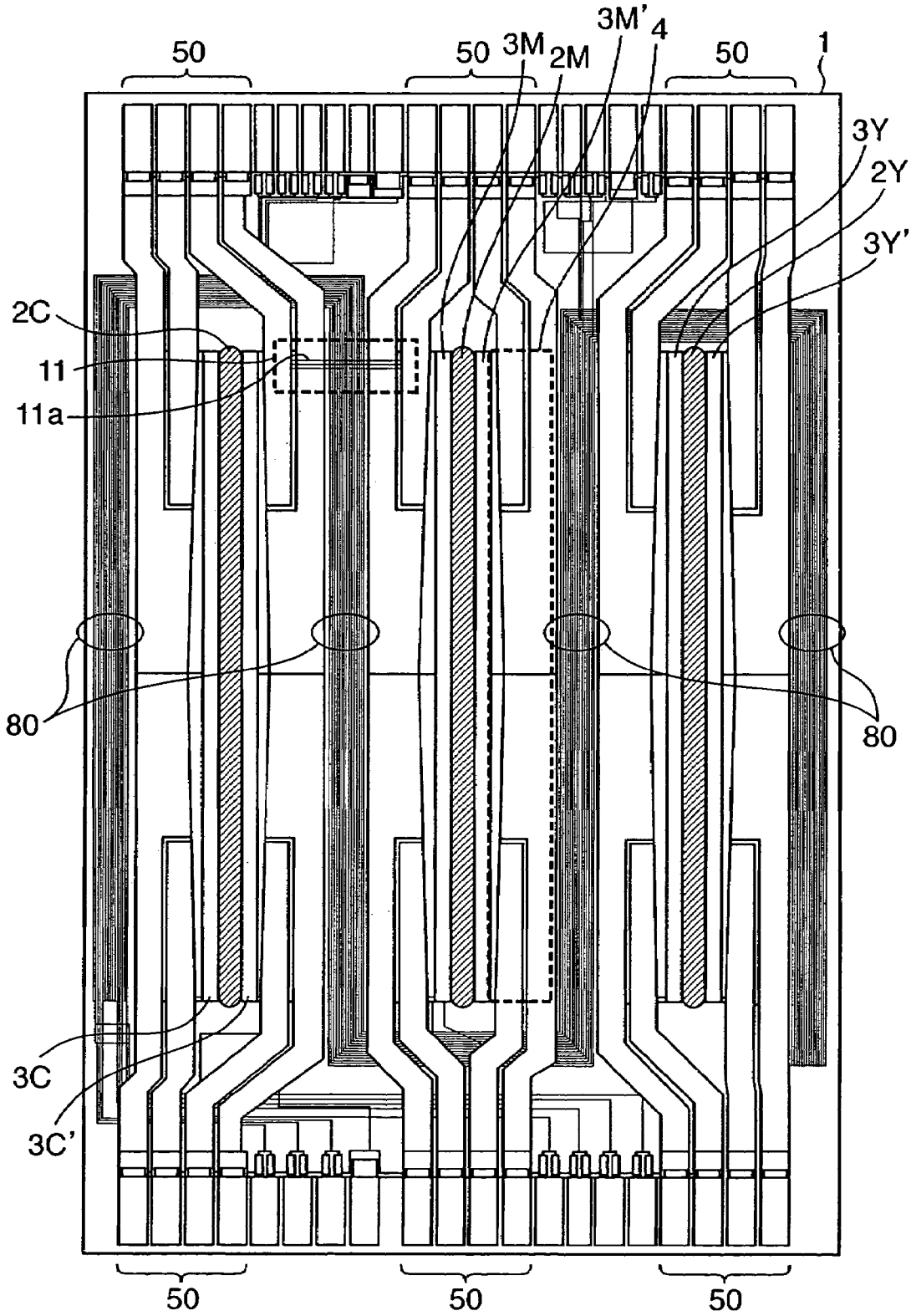
FIG. 11 is a diagram showing the circuit layout of a head substrate integrating twice the number of printing elements of the typical head substrate having the matrix-like wiring for control shown in FIG. 10.

FIG. 11 is a diagram showing the circuit layout of a head substrate integrating twice the number of printing elements of the typical head substrate having the matrix-like wirings for control shown in FIG. 10. It should be noted that, in FIG. 11 as well, constituent elements identical to those of the embodiment described above are assigned identical reference numerals and a description thereof is omitted herein.

As with the embodiment described above, in order to double the number of printing elements, printing element arrays 3C, 3C', 3M, 3M', 3Y and 3Y' are disposed along both sides of the ink channels 2C, 2M and 2Y shown in FIG. 10. The number of shared conductor terminals 50 doubles as a result, but the drive method for the printing element arrays makes it possible to control the activation of the printing elements without that much of an increase in the matrix-like wirings 80.

In other words, the above-described effect is achieved by driving the printing element arrays arranged along both sides of the ink channels at different times. With the present embodiment as well, as with the embodiments described above, the wirings 80 for control are disposed so as to be available as shared use to both ink channels between which they are provided. At this time, as indicated by reference numeral 11, printing elements which can be commonly driven by matrix control between ink channels are substantially identically positioned with respect to the direction of the printing elements array, and wired so as to be commonly controlled.

Such wiring may be disposed in a single continuous line 11*a,* between portions that logically control driver elements that control printing elements of substantially the same position that receive supplies of ink from both ink channels, and merely connected individually to the matrix-like wirings 80 through a through-hole. In this configuration as well, if timing control by both functions is required, a function control terminal may be integrated in the wirings 80 and connected to that position individually through a through-hole.

Figure 12:
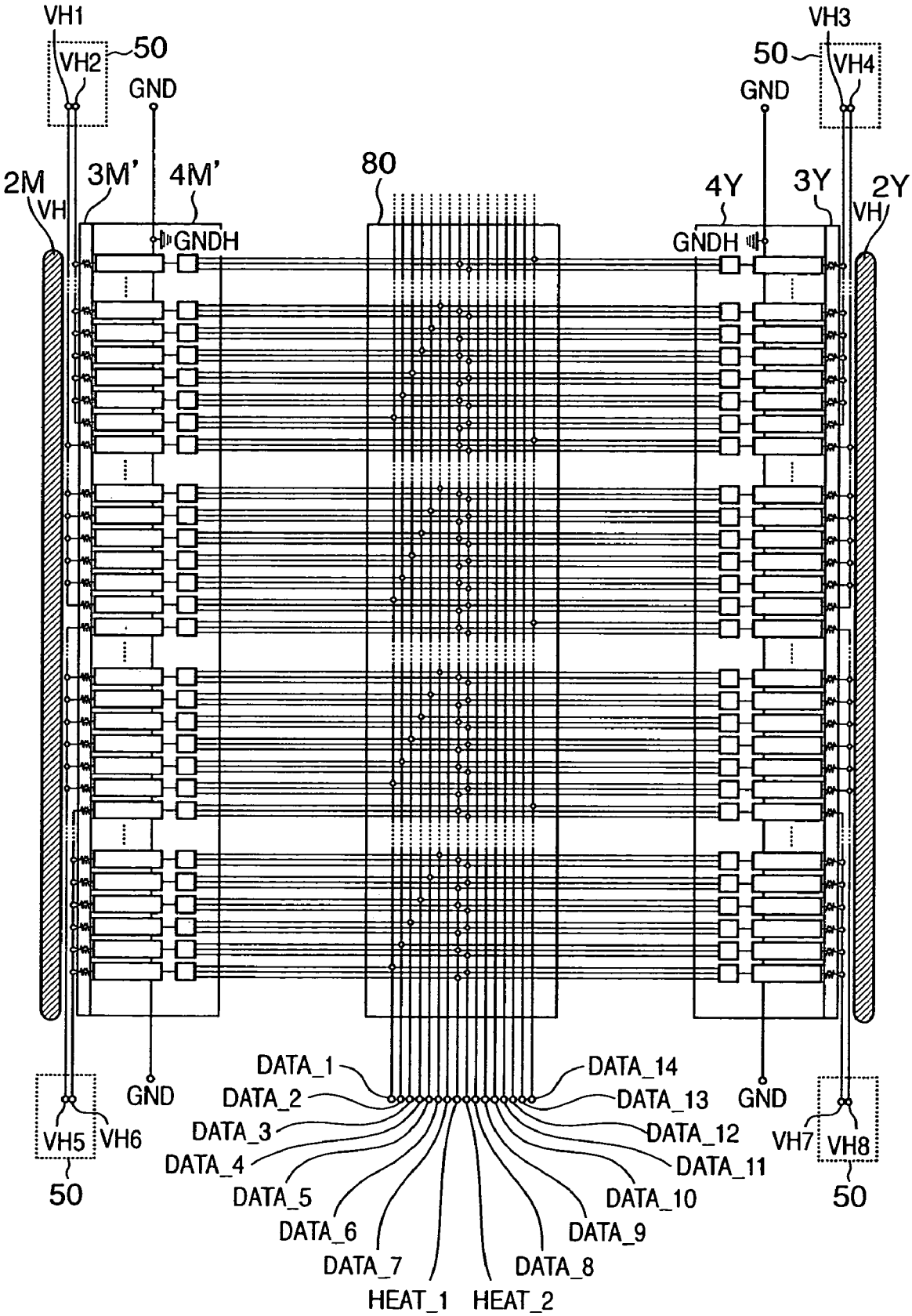
FIG. 12 is an equivalent circuit diagram of the head substrate showing the layout shown in FIG. 11.

FIG. 12 is an equivalent circuit diagram showing the layout shown in FIG. 11. For simplicity of description, the description treats only the circuit configuration disposed between the ink channels 2M and 2Y that are the most characteristic examples of the present embodiment of the present invention, and describes the circuit configuration thereof. It should be noted that, in FIG. 12 as well, constituent elements identical to those of the embodiment described above are assigned identical reference numerals and a description thereof is omitted herein.

Additionally, although the present description is limited to an arrangement between the ink channel that supplies magenta ink and the ink channel that supplies yellow ink, it goes without saying that the similar layout arrangement can also be implemented between the ink channel that supplies cyan ink and the ink channel that supplies magenta ink.

In FIG. 12, VH1-VH8 denote terminals that apply voltage, DATA_1-DATA_14 denote control signal terminals that apply block designation signals during time-division drive, HEAT_1 denotes a control signal terminal that applies a signal for designating a start of a drive signal imparted to printing element arrays 3M' and 3Y, and HEAT_2 denotes a control signal terminal that applies a signal for designating an end of the drive signal imparted to the printing element arrays 3M' and 3Y. The print image data transmitted to the carriage controller 102 integrated in the carriage HC from the printing apparatus main unit controller 101 is developed into matrix control data by the combination of VH1-VH8 and DATA_1-DATA_14.

According to the configuration shown in FIG. 12, the signal lines from the control signal terminals DATA_1-DATA_14 and HEAT_1-HEAT_2 are included in the wirings 80, and the control signals are shared by the printing element arrays 3M' and 3Y.

Therefore, with the present embodiment as described above, by adopting a configuration that disposes signal lines that commonly control two printing element arrays that print by receiving supplies of ink from individual ink channels in an area between two ink channels on the head substrate, the head substrate can be used more efficiently, and further, the area of the head substrate can be further downsized.

It should be noted that although the embodiment described above is described in terms of an inkjet printing method that discharges ink by sending an electric current to heaters to boil the ink, creating bubbles and utilizing the foaming force, the present invention can be applied to other types of inkjet printing methods, such as an inkjet printing method that uses piezoelectric elements to discharge the ink, provided, however, that a multi-channel ink supply method configuration is used.

According to the embodiments as described above, the area for disposition of the control circuits and wiring on the printhead substrate can be downsized. Then, by making the shared wiring portion a plurality of wires that transmit control signals for controlling the sequence of a time-division drive upon time-divisionally driving the plurality of printing elements, the area of the shared circuits and wiring can be greatly reduced. Since the time-division drive control signal wires meander across the printhead substrate like a bus, and the number of time-division drives increases as the number of printing elements increases, such time-division drive control signal lines are effective in reducing the area of the head substrate.

Additionally, according to the above-described arrangement, since the various other circuits including the shared wiring portion are disposed substantially symmetrically about a center of the printhead substrate, an optimum configuration can be achieved that holds the substrate area to a minimum.

Furthermore, an arrangement according to the above-described embodiments is also applicable to any type of multi-channel printhead in which circuit wiring is formed on the head substrate, and thus, for example, similar effects in terms of reducing the area of the substrate can be expected even with a configuration that integrates on the substrate a time-division drive control circuit and shift register circuit like the embodiment described above, or a configuration capable of individually driving the printing elements by a combination of electrodes that selectively electrically activate, and matrix-like wirings that time-divisionally drive the printing elements.

Furthermore, according to the above-described arrangement, the substrate area of the printhead substrate can be downsized.

By so doing, for example, even if the number of printing elements is increased, it is possible to hold any increase in the area of the substrate to a minimum, thus contributing to the downsizing of the printhead, the downsizing of a head cartridge integrating an ink tank in the printhead, and further, the downsizing of the printing apparatus mounting such a printhead.

Moreover, since the distinctive feature of the present invention is an optimum shared wiring arrangement and an optimum circuit layout on a multi-channel head substrate, it goes without saying that the present invention is not limited by either the electrical and mechanical configuration or the software sequencing unique to the printing apparatus.

Further still, the configuration of the present invention is important upon forming a high-performance, high-quality, multi-channel printhead, and in particular can maximize the effect when increasing the number of printing elements. Since the number of printing elements integrated in an inkjet printhead continues to increase annually, the present invention can be said to be a technique indispensable to reducing the production cost of such head substrates.

As many apparently widely different embodiments of the present invention can be made without departing from the spirit and scope thereof, it is to be understood that the inventions not limited to the specific embodiments thereof except as defined in the appended claims.

What is claimed is:

1. A printhead substrate having a plurality of ink supply channels disposed at predetermined intervals comprising:

printing element arrays, each having a plurality of printing elements disposed in an area between two of the ink supply channels, alongside each of the ink supply channels;

a plurality of driving circuit arrays, each provided along respective one of the printing element arrays, for individually driving the printing elements of the printing element arrays;

a drive control circuit, disposed outside the area, for controlling the driving of the printing element arrays, each of the printing element arrays provided along respective one of the two of the ink supply channels;

a shared wiring portion, disposed in the area and elongated in a direction of a length of the printing element arrays, for providing a shared signal making each of the printing elements of the two printing element arrays provided corresponding to two adjacent ink supply channels of the plurality of ink supply channels drivable;

first wirings dedicated to one of the plurality of driving circuit arrays provided corresponding to one of two adjacent ink supply channels, the first wirings extending from the shared wiring portion to the one of the plurality of driving circuit arrays; and second wirings dedicated to another one of the plurality of driving circuit arrays provided corresponding to the other of the two adjacent ink supply channels, the second wirings extending from the shared wiring portion to the other one of the plurality of driving circuit arrays.

2. The printhead substrate according to claim 1, wherein a first printing element array and a second printing element array of the printing element arrays are disposed along both sides of each of the ink supply channels.

3. The printhead substrate according to claim 1, wherein the shared wiring portion is a matrix wiring capable of time-divisionally controlling sending an electric current so as to time-divisionally drive the printing elements.

4. The printhead substrate according to claim 1, wherein ink of different colors is supplied to each of the ink supply channels.

5. The printhead substrate according to claim 1, further comprising a time-divisional drive control circuit that time-divisionally drives the printing elements included in the printing element arrays via the drive control circuit, wherein the shared wiring portion is a plurality of wires that transmit a control signal for specifying a sequence upon the time divisional driving.

6. The printhead substrate according to claim 5, further comprising a decoder circuit that generates a control signal for specifying a sequence upon the time divisional driving.

7. The printhead substrate according to claim 5, wherein the time-divisional drive control circuit is provided on a peripheral portion of the printhead substrate.

8. The printhead substrate according to claim 5, further comprising:

a shift register circuit that inputs a print signal for driving the printing elements; and a latch circuit that latches the print signal input to the shift register circuit.

9. The printhead substrate according to claim 8, wherein the shift register circuit and the latch circuit are provided on a peripheral portion of the printhead substrate.

10. The printhead substrate according to claim 8, wherein the time-divisional drive control circuit, the shift register circuit and the latch circuit are provided on both sides in a longitudinal direction of the printhead substrate.

11. A printhead having a plurality of ink supply channels disposed at predetermined intervals comprising:

printing element arrays, each having a plurality of printing elements disposed in an area between two of the ink supply channels, alongside each of the ink supply channels;

a plurality of driving circuit arrays, each provided along respective one of the printing element arrays, for individually driving the printing elements of the printing element arrays;

a drive control circuit, disposed outside the area, for controlling the driving of the printing element arrays, each of the printing element arrays provided along respective one of the two the ink supply channels;

a shared wiring portion, disposed in the area, for providing a shared signal making each of the printing elements of the printing element arrays provided corresponding to two adjacent ink supply channels of the plurality of ink supply channels drivable;

first wirings dedicated to one of the plurality of driving circuit arrays provided corresponding to one of two adjacent ink supply channels, the first wirings extending from the shared wiring portion to the one of the plurality of driving circuit arrays; and second wirings dedicated to another one of the plurality of driving circuit arrays provided corresponding to the other of the two adjacent ink supply channels, the second wirings extending from the shared wiring portion to the other one of the plurality of driving circuit arrays.

12. The printhead according to claim 11, wherein a first printing element away and a second printing element away of the printing element arrays are disposed along both sides of each of the ink supply channels.

13. The printhead according to claim 11, wherein the shared wiring portion is a matrix wiring capable of time-divisionally controlling sending an electric current so as to time-divisionally drive the printing elements.

14. The printhead according to claim 11, wherein ink of different colors is supplied to each of the ink supply channels.

15. A printing apparatus for printing by discharging ink onto a printing medium using a printhead according to claim 11.

16. The printhead according to claim 11, further comprising a time-divisional drive control circuit that time-divisionally drives the printing elements included in the printing element arrays via the drive control circuit, wherein the shared wiring portion is a plurality of wires that transmit a control signal for specifying a sequence upon the time divisional driving.

17. The printhead according to claim 16, further comprising a decoder circuit that generates a control signal for specifying a sequence upon the time divisional driving.

18. The printhead according to claim 16, wherein the time-divisional drive control circuit is provided on a peripheral portion of a printhead substrate.

19. The printhead according to claim 17, further comprising:

a shift register circuit that inputs a print signal for driving the printing elements; and a latch circuit that latches the print signal input to the shift register circuit.

20. The printhead according to claim 19, wherein the shift register circuit and the latch circuit are provided on a peripheral portion of a printhead substrate.

21. The printhead according to claim 19, wherein the time-divisional drive control circuit, the shift register circuit and the latch circuit are provided on both sides in a longitudinal direction of a printhead substrate.

22. The printhead according to claim 11, further comprising an ink tank integrated into the printhead for supplying ink to each of the ink supply channels.

23. A printing apparatus for printing by discharging ink onto a printing medium using a printhead according to claim 22.

24. The apparatus according to claim 23, wherein the printhead is exchangeable.

* * * * *